US005211668A

United States Patent [19]

Secord

[11] Patent Number: 5,211,668

[45] Date of Patent: May 18, 1993

[54] INFANT HAIR BIB ORGANIZATION

[76] Inventor: Mary A. Secord, 2633 Capp Cir., Kissimmee, Fla. 34744

[21] Appl. No.: 895,646

[22] Filed: Jun. 9, 1992

[51] Int. Cl.[5] ..... A42B 1/06

[52] U.S. Cl. ..... 2/203; 2/49 R; 2/172; 2/202

[58] Field of Search ..... 2/202, 203, 204, 206, 2/207, 172, 51, 185 R, 9, 49 R, 195, 199, DIG. 7, 84, 10, 52, 410, 422, 423, 209.1, 208, 209.3, 205, DIG. 6

[56] References Cited

U.S. PATENT DOCUMENTS

| | | | |
|---|---|---|---|
| 623,086 | 4/1899 | Kaufman | 2/84 |
| 981,738 | 1/1911 | Andrus | 2/84 |
| 1,056,391 | 3/1913 | Baldwin | 2/204 |
| 1,139,675 | 5/1915 | Harris et al. | 2/203 |
| 1,232,992 | 7/1917 | Stering | 2/10 |
| 1,251,657 | 1/1918 | Hart | 2/10 |
| 1,309,783 | 7/1919 | Slawin | 2/206 |
| 1,690,736 | 11/1928 | Leicht | 2/208 |
| 1,800,051 | 4/1931 | Blanco | 2/206 |
| 4,042,976 | 8/1977 | Reynolds | 2/203 |
| 4,180,868 | 1/1980 | Snow | 2/208 |
| 4,961,232 | 10/1990 | Hulsey | 2/206 |
| 5,046,195 | 9/1991 | Koritan | 2/199 |
| 5,099,524 | 3/1992 | Linday | 2/195 |
| 5,153,945 | 10/1992 | Kobayashi et al. | 2/413 |

FOREIGN PATENT DOCUMENTS

| | | | |
|---|---|---|---|
| 479093 | 2/1916 | France | 2/203 |
| 1224285 | 6/1960 | France | 2/DIG. 6 |
| 2538225 | 6/1984 | France | 2/84 |
| 12062 | of 1913 | United Kingdom | 2/172 |
| 141447 | 2/1919 | United Kingdom | 2/203 |
| 523530 | 7/1940 | United Kingdom | 2/204 |

OTHER PUBLICATIONS

Gershman, Maurice; "Self Adhering Nylon Tapes", *Journal of AMA*, vol. 168, No. 7, Oct. 18, 1958.

*Primary Examiner*—Clifford D. Crowder
*Assistant Examiner*—Amy Brooke Vanatta
*Attorney, Agent, or Firm*—Leon Gilden

[57] ABSTRACT

An infant hair bib is arranged for securement about an infant having an elastomeric rimmed facial opening and elastomeric rimmed neck opening to provide and afford protection for an infant's hair during a feeding procedure. The invention is arranged to include side wall ear openings, as well as cover flaps and optional bib structure, and a sun visor member to afford protection to an infant when feeding in an outdoor environment.

1 Claim, 4 Drawing Sheets

INFANT HAIR BIB ORGANIZATION

BACKGROUND OF THE INVENTION

1. Field of the Invention

The field of invention relates to infant clothing, and more particularly pertains to a new and improved infant hair bib organization wherein the same is arranged to afford protection to an infant during a feeding procedure.

2. Description of the Prior Art

The feeding of infants is frequently associated with the undesired distribution of food relative to the food's origin and directing such food to the infant's hair as the infant will rub its hands in the food and into the hair during a feeding procedure. While bib structure in the prior art has been directed to affording protection to an infant's torso, it heretofore has not been addressed to the protection of an infant in a feeding procedure. Prior art patents such as indicated in U.S. Pat. Nos. 4,924,528; 4,884,299; 4,862,508; 4,793,004; and 4,706,303 have been directed to the protection of an infant's torso during feeding, and as noted, does not provide for the complete protection of an infant's hair and the like during such feeding.

Accordingly, it may be appreciated that there continues to be a need for a new and improved infant hair bib organization as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of bib arrangements now present in the prior art, the present invention provides an infant hair bib organization wherein the same is directed to the protection and covering of an infant's hair relative to an infant in a feeding procedure. As such, the general purpose of the present invention, which will be described subsequently in greater detail, is to provide a new and improved infant hair bib organization which has all the advantages of the prior art infant clothing and none of the disadvantages.

To attain this, the present invention provides an infant hair bib arranged for securement about an infant having an elastomeric rimmed facial opening and elastomeric rimmed neck opening to provide and afford protection for an infant's hair during a feeding procedure. The invention is arranged to include side wall ear openings, as well as cover flaps and optional bib structure, and a sun visor member to afford protection to an infant when feeding in an outdoor environment.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved infant hair bib organization which has all the advantages of the prior art infant clothing and none of the disadvantages.

It is another object of the present invention to provide a new and improved infant hair bib organization which may be easily and efficiently manufactured and marketed.

It is a further object of the present invention to provide a new and improved infant hair bib organization which is of a durable and reliable construction.

An even further object of the present invention is to provide a new and improved infant hair bib organization which is susceptible of a low cost of manufacture with regard to both materials and labor, and which accordingly is then susceptible of low prices of sale to the consuming public, thereby making such infant hair bib organizations economically available to the buying public.

Still yet another object of the present invention is to provide a new and improved infant hair bib organization which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
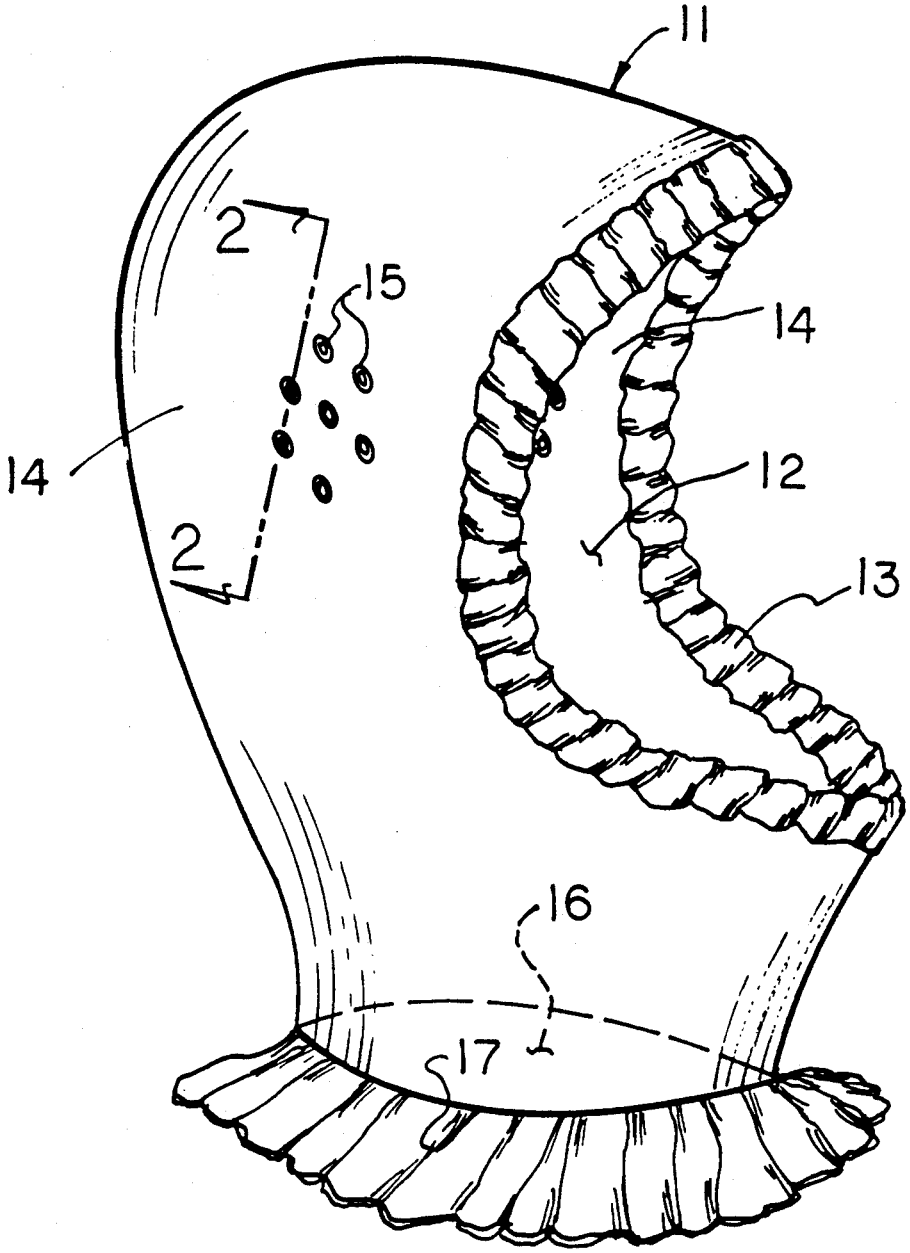
FIG. 1 is an isometric illustration of an infant hair bib organization as contemplated by the instant invention.
Figure 2:
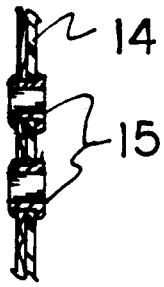
FIG. 2 is an orthographic view, taken along the lines 2—2 of FIG. 1 in the direction indicated by the arrows.

With reference now to the drawings, and in particular to FIGS. 1 to 8 thereof, a new and improved infant hair bib organization embodying the principles and concepts of the present invention and generally designated by the reference numeral 10 will be described.

More specifically, the infant hair bib organization 10 of the instant invention essentially comprises a flexible hood member 11 having a facial opening 12 formed with an elastomeric perimeter 13 about the facial opening 12. The hood is formed with hood side walls 14 having side wall ear openings 15 directed therethrough, wherein the ear openings may be defined by resilient grommets directed through the side wall to maintain geometric integrity of the openings 15. An annular head receiving opening 16 is directed through a lower distal end of the hood member 11 having an annular elastomeric opening perimeter 17 directed about the hood annular head receiving opening 16. A lower edge flexible skirt 18 projects exteriorly of the hood from the head receiving opening 16.

Figure 3:
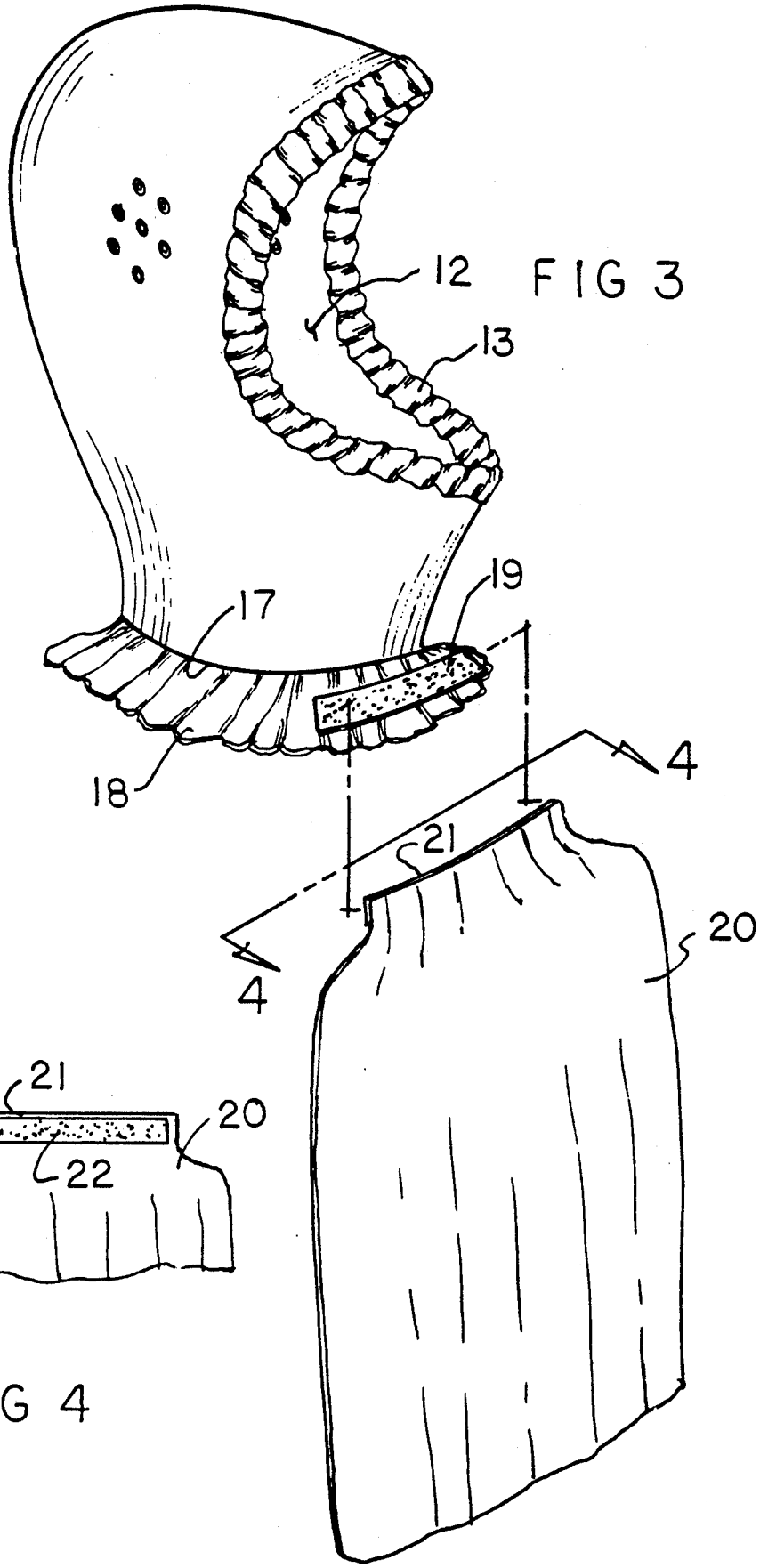
FIG. 3 is an isometric aspect of the invention incorporating a torso bib structure.
Figure 4:
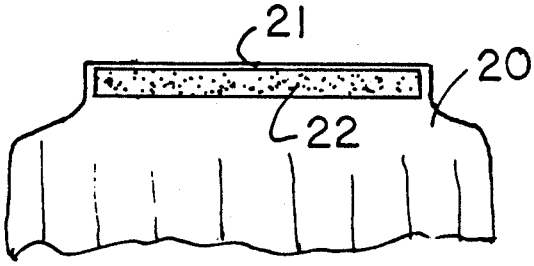
FIG. 4 is an orthographic view, taken along the lines 4—4 of FIG. 3 in the direction indicated by the arrows.

The FIG. 3 indicates the use of a flexible torso bib web 20 having a bib web upper edge 21 to include a bib web hook and loop fastener strip 22. The bib web hook and loop fastener strip 22 is arranged for selective securement to a flexible skirt hook and loop fastener strip 19 mounted to the flexible skirt 18 below the facial opening 12. In this manner, facial and torso protection is afforded to an infant during a feeding procedure.

Figure 5:
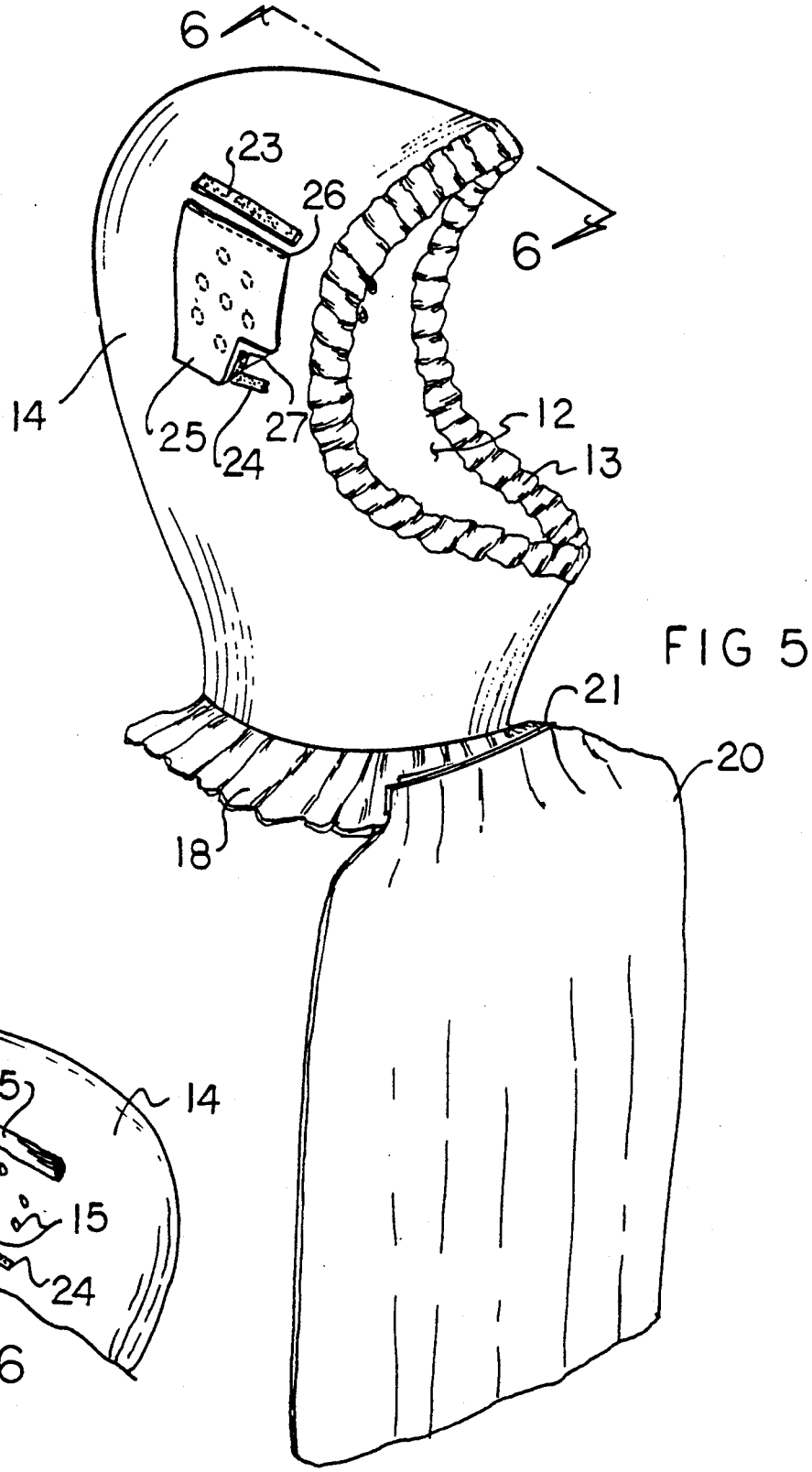
FIG. 5 is an isometric illustration of the invention further employing ear covering web structure.
Figure 6:
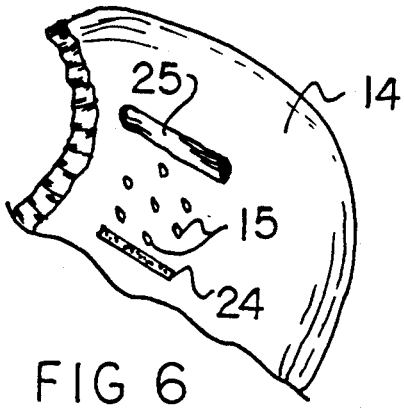
FIG. 6 is an orthographic view, taken along the lines 6—6 of FIG. 5 in the direction indicated by the arrows.
Figures 7, 8:
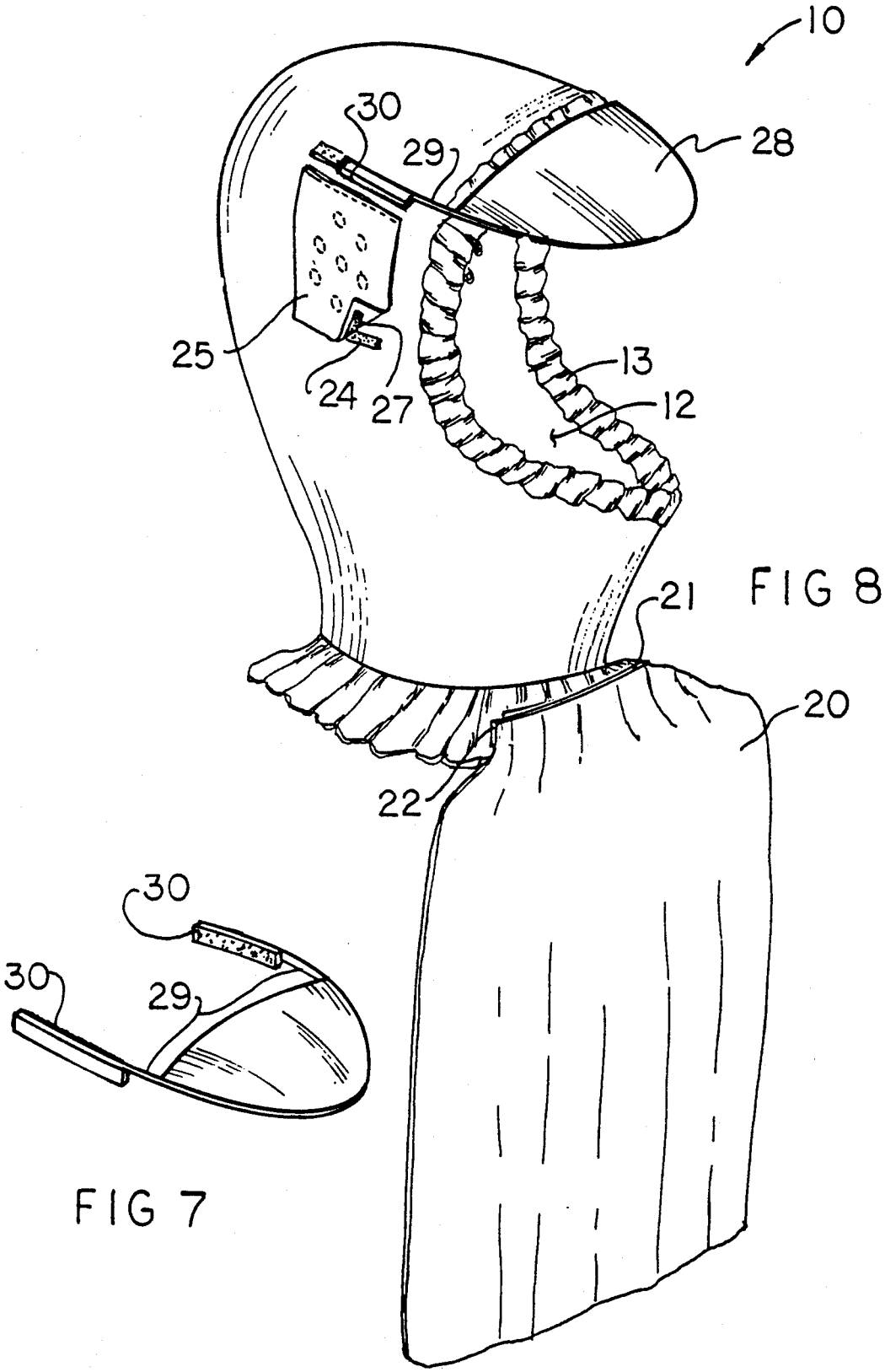
FIG. 7 is an isometric illustration of a sun visor member utilized by the invention.
FIG. 8 is an isometric illustration of the invention in a completed configuration.

The side walls 14 are arranged in the FIGS. 5 and 8 for example, to include a side wall upper hook and loop fastener strip 23 spaced above the openings 15 in a parallel relationship relative to a side wall lower hook and loop fastener strip 24 to each side wall 14. A side wall cover web 25 is mounted to each side wall 14 adjacent the upper hook and loop fastener strip 23 and above the openings 15. In this manner, the cover web 25 is formed with a cover web lower hook and loop fastener strip 27 at a lower distal end of the cover web 25, wherein the cover web includes a cover web upper seam 26 fixedly mounting the upper distal edge of the cover web in adjacency to the upper hook and loop fastener strip 23. As indicated in a first position, the cover web lower hook and loop fastener strip 27 is secured to the side wall lower hook and loop fastener strip 24 to afford protection to an infant when feeding in an exterior environment, as the ears are frequently subject to infection and the like, particularly in infants, and such protection is frequently deemed necessary. In a second position, the cover web 25 is furled to permit securement of the lower hook and loop fastener strip 27 to the side wall upper hook and loop fastener strip 23 to permit exposing of the ear openings. It should be further noted that the cover web 25 is formed of an air permeable fabric material to permit air flow therethrough.

The FIG. 7 notes the further use and employment of a visor flange 28 having visor flange leg members 29 projecting rearwardly of the visor flange, wherein each leg member 29 includes a leg member hook and loop fastener strip 30 arranged for securement to the side wall upper hook and loop fastener strip 23 to afford facial protection as well as ear protection to an infant when feeding in an outdoor environment.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An infant hair bib organization, comprising, a flexible hood member, the hood member having a facial opening directed through the hood member, with the facial opening including an elastomeric opening perimeter in surrounding relationship relative to the facial opening, the hood member including hood side walls, and each hood side wall of said hood side walls includes a plurality of ear openings directed therethrough, with the ear openings positioned in adjacency to and rearwardly of the facial opening, and the hood member further including a hood lower annular head receiving opening positioned below the facial opening and the ear openings, and the head receiving opening directed through a lower distal end of the hood member, and a hood lower elastomeric opening perimeter is fixedly mounted in surrounding relationship relative to the hood lower annular head receiving opening, and a hood lower edge flexible skirt is fixedly mounted to the hood lower elastomeric opening perimeter, with the hood lower edge flexible skirt extending exteriorly thereof, and the hood lower edge flexible skirt includes a flexible skirt hook and loop fastener strip positioned fixedly on the hood lower edge flexible skirt medially of and below the facial opening, and a flexible torso bib web, the flexible torso bib web including a bib web upper edge, and a hook and loop fastener strip mounted to the bib web adjacent the bid web upper edge, with the bib web hook and loop fastener strip arranged for selective securement to the flexible skirt hook and loop fastener strip, and each side wall includes a side wall upper hook and loop fastener strip positioned above the ear openings, and a side wall lower hook and loop fastener strip positioned below the ear openings, wherein the upper hook and loop fastener strip and the lower hook and loop fastener strip are arranged in a parallel relationship relative to one another, and each side wall includes a side wall cover web having a side wall cover web upper seam mounted to the side wall below one of said side wall upper hook and loop fastener strips, and the cover web including a cover web lower hook and loop fastener strip arranged for selective securement to the side wall lower hook and loop fastener strip in a first position and selectively to the side wall upper hook and loop fastener strap in a second furled position, and a visor flange, the visor flange including visor flange leg members, and each leg member of said visor flange leg members includes a leg member hook and loop fastener strip, wherein each leg member hook and loop fastener strip is arranged for selective securement to the side wall upper hook and loop fastener strip of a respective side wall when the cover web is in the first position.

* * * * *